US005509482A

United States Patent [19]

Dillon et al.

[11] Patent Number: 5,509,482

[45] Date of Patent: Apr. 23, 1996

[54] PERFORATION TRIGGER BYPASS ASSEMBLY AND METHOD

[75] Inventors: David B. Dillon, Aliso Viejo; David O'Mara, Canyon Country, both of Calif.

[73] Assignee: Trico Industries, Inc., Huntington Park, Calif.

[21] Appl. No.: 312,405

[22] Filed: Sep. 26, 1994

[51] Int. Cl.[6] ..... E21B 29/02; E21B 29/08; E21B 43/11

[52] U.S. Cl. ..... 166/297; 166/299; 166/55; 166/317

[58] Field of Search ..... 166/297, 299, 166/55, 317, 63

[56] References Cited

U.S. PATENT DOCUMENTS

| | | | |
|---|---|---|---|
| 4,662,450 | 5/1987 | Haugen | 166/63 X |
| 4,804,044 | 2/1989 | Wesson et al. | 166/297 |
| 4,901,802 | 2/1990 | George et al. | 175/4.52 |
| 4,969,525 | 11/1990 | George et al. | 166/297 |
| 5,050,672 | 9/1991 | Huber et al. | 166/55 |
| 5,161,616 | 11/1992 | Colla | 166/297 |
| 5,249,630 | 10/1993 | Meaders et al. | 166/55 X |
| 5,355,957 | 10/1994 | Burleson et al. | 166/55 X |

*Primary Examiner*—Frank S. Tsay
*Attorney, Agent, or Firm*—Flehr, Hohbach, Test, Albritton & Herbert

[57] ABSTRACT

A perforation trigger bypass conduit assembly (10) for a well perforation gun (17) positioned in a well casing (12) at a down-hole location below a tubular completion assembly (16). A pressure sensing device (20) senses a detonation pressure of fluid communicated from a pump (21) through bypass conduit assembly (10) to the sensor (20). The sensing device (20) triggers the gun upon sensing a pressure surpassing a predetermined value, which perforates the casing (12). The bypass conduit assembly (10) is formed to enable blocking of the bypass conduit assembly (10) after triggering of the perforation gun (17) to prevent pumping of production and power fluid back into the formation upon severing of a portion (34) of the conduit assembly (10). Blocking can be effected by removing a member (25) which contains a passageway (51) forming part of the bypass conduit assembly (10) and replacing the removable member (25) with a passageway-free insert member (35).

21 Claims, 4 Drawing Sheets

PERFORATION TRIGGER BYPASS ASSEMBLY AND METHOD

TECHNICAL FIELD

The present invention relates, generally, to perforation gun apparatus, and, more particularly, relates to trigger bypass assemblies for down-hole perforation guns.

BACKGROUND ART

As the demand for natural oil and gas increases, so does the need for efficient retrieval of these limited resources from their subterranean positions. Hence, through an abundance of research and development, the techniques and equipment employed to remove these substances have become increasingly sophisticated and efficient. Production of underground fluid usually includes drilling of a well into a formation containing the desired fluid and then removing the fluid therefrom, usually by a mechanical or jet pump. In some instances, such as in the Middle East, sufficient bottom hole pressure is available in the formation to force the production fluid to the surface, where it is collected and utilized for commercial purposes. When natural lifting of the well is insufficient to deliver the production fluid, however, it is necessary to deploy a pump, such as a sucker rod-type or hydraulic-type pump, to lift the production fluid from the formation.

Recent developments have favored the use of hydraulic or down-hole jet pumps over mechanical-type, sucker-rod pumps. Briefly, jet pumps and hydraulic pumps generally include a power fluid line operably coupled to the entrance of the pump, and a return line coupled to receive fluids from a discharge end of the pump. As the pressurized power fluid is forced, by a pump at the surface, down through the down-hole pump, the power fluid draws in and intermixes with the production fluid, which then is recovered with the power fluid through the return line.

Typically, after a well has been drilled, a steel tubular casing, extending the length of the well, is lowered down into the well. Subsequently, uncured concrete is pumped down the casing and forced out of the bottom of the casing and up the outside of the casing into an annulus formed between an outer surface of the casing and drilled formation walls of the well. The concrete then cures to firmly anchor the casing to the well walls and seal off the well.

To access the formation fluids through the now sealed well casing, both the casing and the concrete are perforated at a predetermined down-hole location well below both the slurry plug level and the formation fluid level. These perforations allow the production fluid to enter the well casing from the formation for retrieval using the pump. Due to the difference in pressure between the formation and the well casing interior, the in-rush of the production fluid into the well casing is substantial enough to clean the perforation passages of any debris for unobstructed passage of production fluid into the well casing. As mentioned, however, the predetermined slurry plug remaining in the well above the perforations prevents blowout of the in-rushing formation fluids.

To form the casing perforations at the remote down-hole location, a perforation gun assembly capable of piercing the casing is suspended from a bottom hole assembly of the pump. Detonation or triggering of the gun assembly causes projectiles in the gun to be propelled outwardly through the casing, the concrete annulus and into the formation. As mentioned, this causes an insurgence of fluids into the well casing at a force sufficient to clear the perforation holes of any debris.

Perforation gun assemblies can be triggered by operator-induced pressure differentials or automatically triggered or detonated by formation-induced pressure differentials. Triggering in either case is based upon use of a pressure sensor assembly which is capable of sensing a predetermined pressure and/or predetermined pressure differential between the pump discharge pressure and the formation pressure or well casing pressure.

Typically, the pressure sensor assembly of the perforation gun is located at or on the perforation gun. Thus, it is necessary to communicate the pump discharge pressure to the pressure transducer located on the gun assembly. A trigger bypass tube extends inside the well casing from a position in fluid communication with the discharge end of the pump all the way down to the gun assembly, which sometimes is a distance exceeding 1000 feet. Hence, the pressure at the discharge end of the pump is transmitted in the bypass tube to the pressure sensor on the perforation gun.

When operator-induced triggering is employed, the initial operation of the pump, before the perforation of the well casing by the gun assembly, removes any production fluid (and excess drilling mud) from the well casing until the slurry plug decreases to a predetermined height. At this time, the operator closes off the power fluid line, and redirects the power fluid, pressurized from a ground level pumping station, down the return line. The power fluid in the return line passes through the pressure bypass conduit to the pressure sensor at the perforation gun. The pressure transducer at the perforation gun is exposed to and senses the rise in pressure caused by pumping of power fluid into the bypass conduit. When a pre-set pressure level is reached, the sensor triggers the perforation gun. This pre-set predetermined trigger pressure for operator-induced triggering is typically much higher than the normal production or discharge pressure generated by the pump to ensure that inadvertent triggering does not occur. For formation-induced triggering, the perforation gun assembly is automatically discharged upon the pressure sensor assembly sensing a predetermined differential pressure between the pump discharge and the formation pressure. As the level of the production fluid drops, the production fluid pressure inside the well casing decreases, thereby increasing the pressure differential relative to the pump discharge pressure. When the pressure differential between the pump and the formation reaches a predetermined level, the pressure sensor assembly triggers the gun automatically.

In either instance (i.e., operator-induced or automatic formation-induced triggering), due to the extreme violence of the detonation, the stainless steel pressure transmitting bypass tube is generally severed. Because of the positive discharge pressure from the jet pump, the production and power fluids being pumped will be discharged through the severed bypass tube, which returns a measurable portion of the overall produced fluids back into the formation. This is especially inefficient and costly since the fluids will have to be recovered again. Moreover, the constant stream of ejected production fluid from the bypass tube may prematurely erode or damage the casing and the well components over time.

DISCLOSURE OF INVENTION

Accordingly, it is an object of the present invention to provide a new trigger bypass tube apparatus and method which reduces the waste of production and power fluids from severed trigger bypass conduits.

It is another object of the present invention to provide a perforation trigger bypass apparatus and method which maintains fluid communication between a discharge end of the pump and a pressure sensor trigger for a perforation gun.

Another object of the present invention is to provide a perforation trigger bypass apparatus and method which can be operated to block return of production and power fluids to the formation while retaining a substantial portion of the bypass assembly resident in the well casing.

Still another object of the present invention is to provide a perforation trigger bypass apparatus and method which increases fluid production while reducing operating costs.

Yet another object of the present invention is to provide a perforation trigger bypass apparatus and method which can be retrofit to existing tubular completion assembly including bottom hole equipment.

It is a further object of the present invention to provide a perforation trigger bypass apparatus and method which is durable, compact, easy to maintain and has a minimum number of components.

In accordance with the foregoing objects, the present invention includes a perforation trigger bypass conduit assembly for use with a down-hole completion assembly which includes a rigid, elongated tubular casing extending into a formation having a production fluid therein. A tubular completion assembly, preferably a bottom-hole assembly, is positioned in the casing while a pump assembly is operably supported in the bottom-hole assembly to extract the production fluid from the well. A perforation gun assembly is supported in the casing by the down-hole assembly, and is capable of a controlled detonation to perforate the casing and thereby allow the production fluid to enter the casing. A pressure sensing device senses a detonation pressure, which may be either operator-induced or formation-induced, and triggers the perforation gun assembly when the pressure surpasses a predetermined detonator pressure. A pressure bypass conduit assembly is provided which includes a passageway providing fluid communication between a discharge end of the pump assembly and the pressure sensing device for the communication of the detonation pressure to the sensing device.

In the improved apparatus and method, the pressure bypass conduit assembly is formed for selective blocking of fluids from being pumped back into the formation through a severed bypass conduit component upon firing of the perforation gun.

In the preferred embodiment, blocking of the bypass conduit is accomplished by removing a removable member which provides a portion of the bypass conduit from the bottom-hole assembly and replacing the removable member with an insert. The insert device is formed and dimensioned to reposition the down-hole assembly standing valve in a manner blocking passage of the pumped fluids back into the severed portion of the bypass conduit.

A method of the present invention for preventing discharge of fluid from a down-hole pump assembly into the formation upon perforation of the well casing using a trigger bypass apparatus, comprises briefly, the step of: after discharge of the gun assembly, blocking the pressure bypass conduit to prevent communication of the fluids discharged from the pump assembly into the well casing through the bypass conduit. This blocking step preferably is accomplished by moving a portion of the bypass conduit to close or block the conduit while a substantial portion of the bypass conduit assembly remains in residence in the well.

BRIEF DESCRIPTION OF THE DRAWING

The assembly of the present invention has other objects and features of advantage which will be more readily apparent from the following description of the best mode of carrying out the invention and the appended claims, when taken in conjunction with the accompanying drawing, in which:

BEST MODE OF CARRYING OUT THE INVENTION

Figure 1:
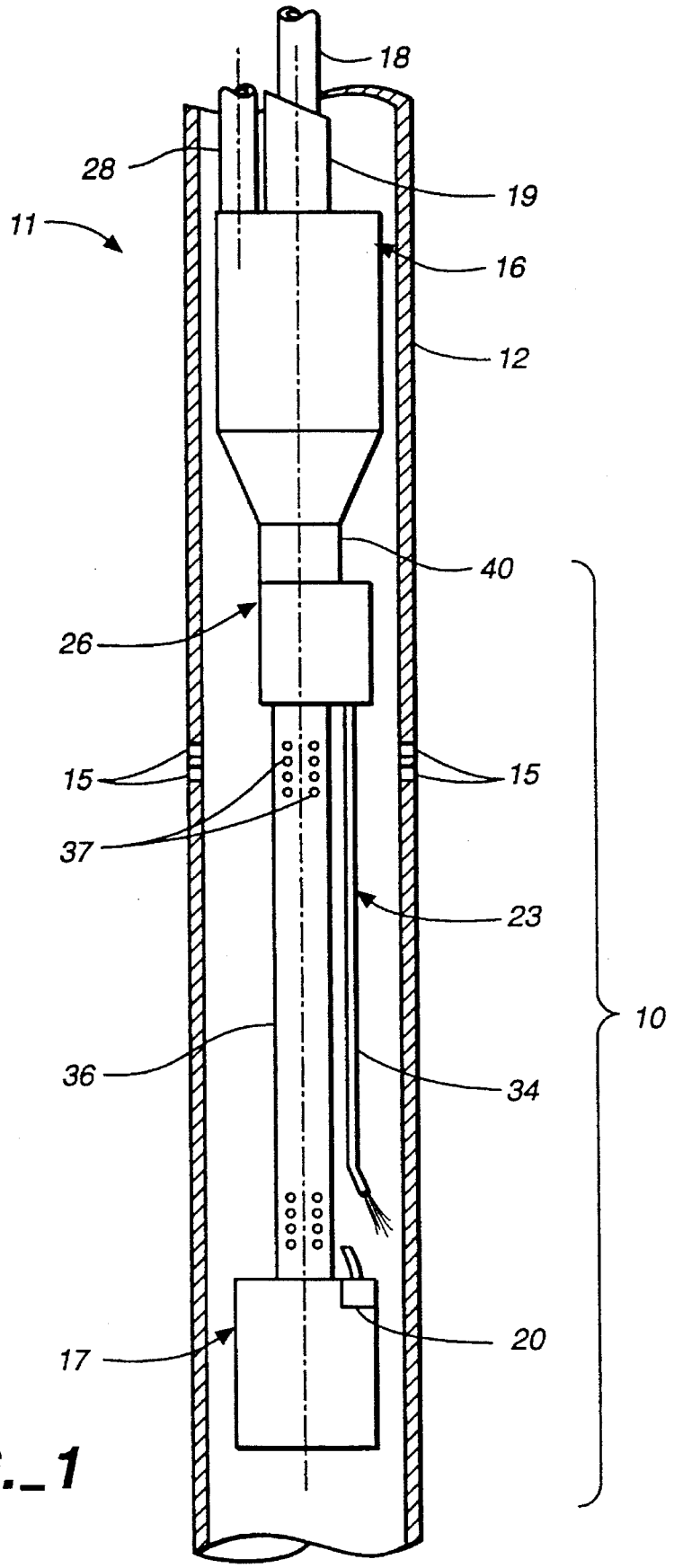
FIG. 1 is a fragmentary side elevation view, in partial cross-section, of a down-hole completion assembly employing a perforation trigger bypass apparatus constructed in accordance with the present invention.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

The present invention is directed to a perforation trigger bypass apparatus employing a conduit assembly which eliminates :many of the problems associated with the prior art bypass assemblies. Further, the present invention can be adapted to cooperate with perforation gun assemblies employing either operator-induced detonation or the automatic formation-induced detonation.

Figure 2:
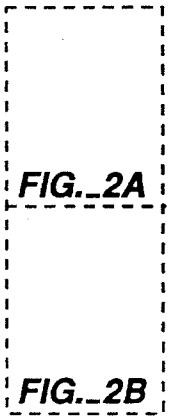
FIG. 2 is an enlarged, fragmentary, side elevation view, in cross-section, of the perforation trigger bypass apparatus of FIG. 1 and illustrating a bypass conduit assembly in an open condition.
Figure 2A:
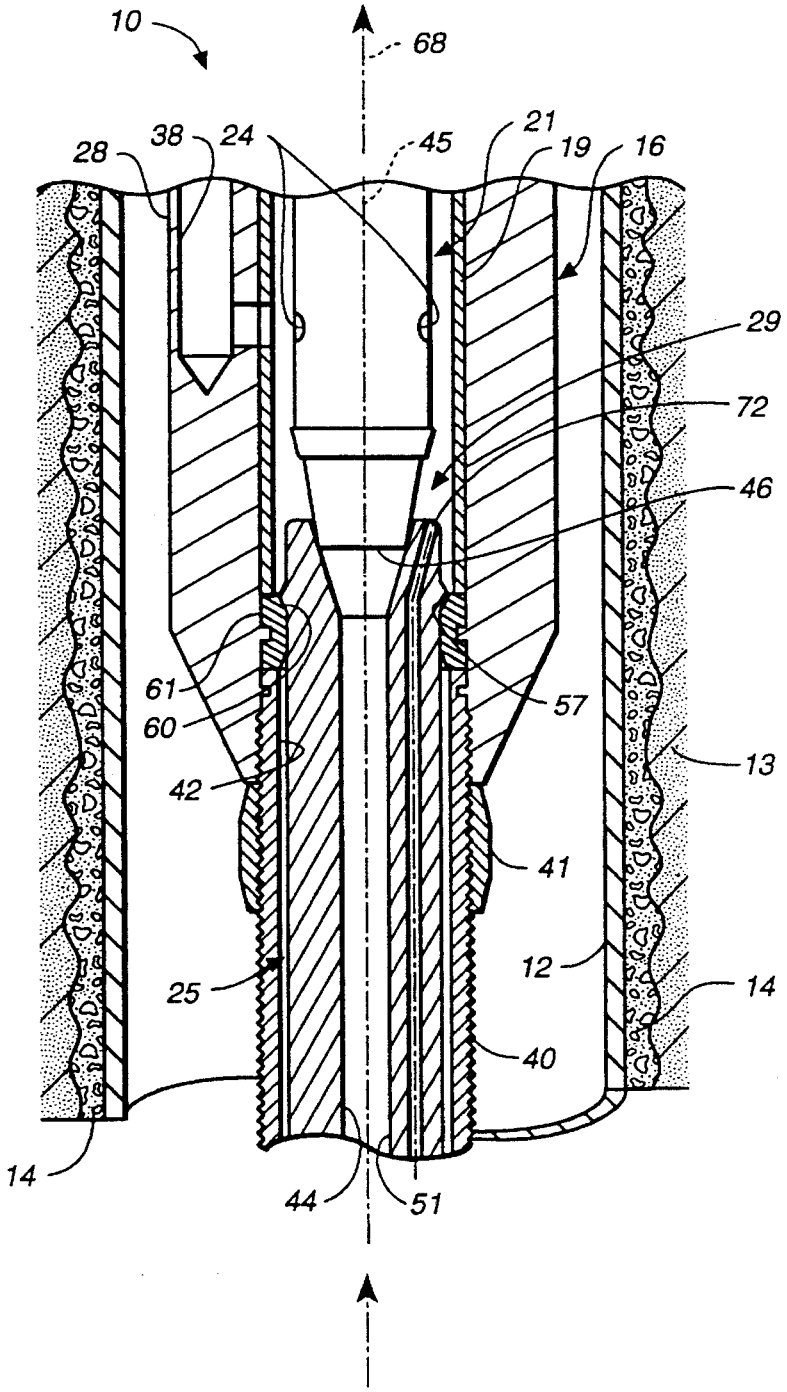
Figure 2B:
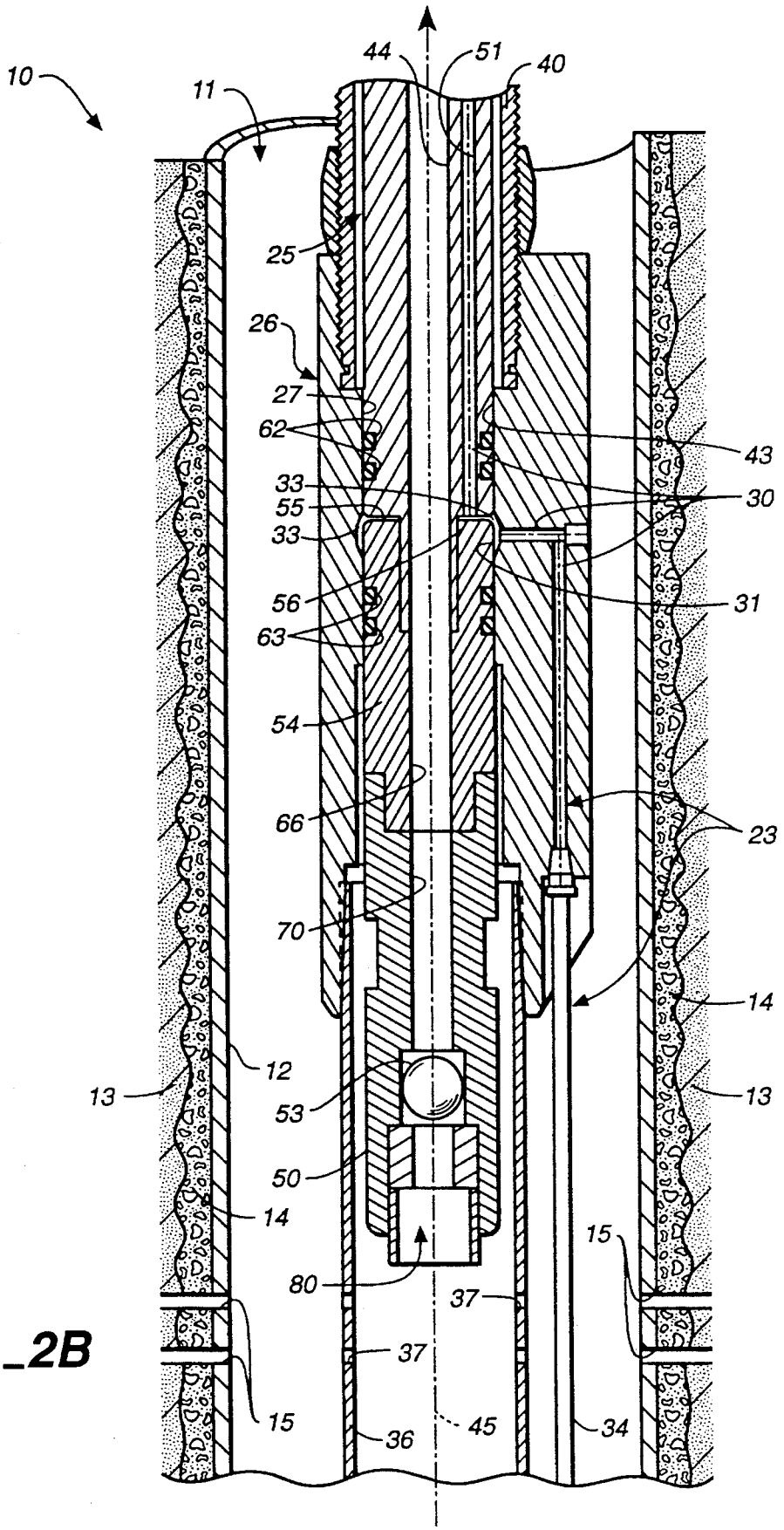

FIGS. 1 and 2 illustrate the present bypass apparatus, generally designated 10, for a well or down-hole completion assembly 11 which typically includes a rigid, elongated tubular casing 12 extending into a formation 13. As previously described, the well is sealed with concrete 14 (FIGS. 2 and 3) which is contained in the annulus between an exterior of casing 12 and formation 13. A tubular completion assembly, generally designated 16, is supported by tubing string 19, as well as power line 18 and return line 28, proximate a bottom portion of casing 12, and tubular completion assembly 16 receives and supports a pump assembly, schematically shown as 21 in a pump-receiving cavity 29 inside tubing string 19. The pump assembly is formed in a conventional manner and is used to pump production fluid from well 11. Extending from the top of tubular completion assembly 16 is a power fluid line 18, which is coupled to communicate power fluid to the intake of pump assembly 21. A return fluid line 28 is coupled to return production and power fluid from the discharge end 24 of pump assembly 21 to the surface of the well site.

A perforation gun assembly, generally designated 17, is supported in the well casing below tubular completion assembly 16, which is preferably a bottom-hole assembly 16, by tubular tension member 36. Further, while the gun assembly of the present invention is preferably employed in conjunction with a jet pump assembly, it will be understood that the present invention may be deployed in any down-hole completion with or without a down-hole jet pump.

Perforation gun assembly 17 is capable of a controlled detonation (either operator-induced or formation-induced) to cause the initial perforation of casing 12 and concrete 14 at a first down-hole location or to cause perforation of the casing and concrete at a second lower location when pressure in the formation at the initial location becomes undesirably low. A pressure sensing device 20 senses a detonation or triggering pressure (i.e., a predetermined pressure for the operator-induced detonation or a pressure differential between a discharge pressure at pump assembly 21 and the production fluid pressure in casing 12 for automatic formation-induced detonation). The detonation pressure is created by the power fluid during operator-induced detonation (i.e., the return line 28 is valved off, causing the power fluid pressure to increase in the pressure bypass conduit assembly 23, in a manner described in detail below, which is sensed by pressure sensor 20 on the gun assembly); and in the automatic formation-induced detonation, the detonation pressure is a predetermined pressure differential between the fluid pumped from discharge end 24 of the pump assembly and the formation fluid pressure in casing 12.

Pressure bypass apparatus 10 is formed to provide a bypass conduit assembly, generally designated 23, extending from discharge end 24 of pump assembly 21 to the pressure sensing device 20 for the communication of the pump discharge pressure or return line pressure to sensor 20.

In the preferred form, pressure bypass conduit assembly 23 includes a severable conduit or tube 34 which is coupled at a lower end to sensor 20 and at an upper end to a housing member 26. Housing 26 has a central bore 27 which extends longitudinally therethrough, and further includes a housing passageway 30 which is coupled to conduit 34. Housing passageway 30 terminates at a port 31 extending into a mid-portion of central bore 27. Bypass conduit assembly 10 further includes a movable member 25, which advantageously may be provided by a removable annular member dimensioned on the exterior for sliding engagement with central bore 27 of housing 26. An annular groove or pocket 33 is formed between a shoulder 56 on member 25 and end 55 of a lower annular member 54, also mounted in bore 27. Removable annular member 25 is also formed with an axially extending communication passageway 51 which extends from pump discharge 24 to annular groove 33. Pump discharge pressure, or return line pressure, therefore, is communicated to sensor 20 by fluid which passes first through communication passageway 51 in member 25 to annular groove 33, then through port 31 to housing passageway 30 in housing 26, and finally through conduit 34 to sensor 20. Pressure bypass assembly 23 of the present invention, therefore, includes members 25 and 26 and conduit 34. The assembly is referred to as a "bypass" since pressure bypasses, or is communicated around, a standing valve assembly 50 which would prevent pressure at pump discharge 24 from reaching sensor 20.

It will be appreciated that the trigger bypass assembly of the present invention is capable of deployment with most bottom-hole pump assemblies including "open" and "closed" power fluid systems. Further, as best viewed in FIG. 1, perforation gun assembly 17 is suspended from housing assembly 26 by tubing 36, which includes a plurality of apertures 37 radially positioned around tubing 36. These apertures provide fluid flow therethrough for communication and extraction of production fluid to the intake port 35 of standing valve 50. Perforation gun assembly 17, pump assembly 21 and standing valve 50 are well known in the field and do not alone contribute to the novelty of the present invention.

Standing valve 50, however, can be seen in FIG. 2 to be mounted inside housing 26 and includes a one-way check valve assembly or ball 53, which allows production fluid to flow upwardly in bore 70 but prevents reverse flow. Standing valve 50 is threadably secured to annular member 54, with bore 70 aligned with bore 66 in member 54. The member 54, in turn, is threadably mounted to removable annular member 25. A tubular housing extension 40 supports the upper end of housing 26, and housing extension 40 is threadably joined to bottom hole assembly 16 and includes a locking nut 41 for locking engagement thereto.

When pump 21 is operated, a reduced pressure is created at pump intake end 46, which is communicated down aligned bores 44, 66 and 70 to standing valve intake port 80. Production fluid enters the valve and is drawn into the pump. Thereafter, it is discharged, with the power fluid, at port 24 into cavity 29. The combination of production fluid and power fluid then flows through duct 38 and up return line 28 to the surface of the well.

An upper end of bore 44 is tapered outwardly and formed to removably seat an intake portion 46 of pump assembly 21 thereagainst.

In accordance with the present invention, when bypass conduit assembly 23 is in an "open" condition, transmission of the pump discharge pressure in cavity 29 is permitted, through bypass conduit assembly 23, to pass from discharge end 24 of pump 21 to pressure sensing device 20. An upper entrance end 72 of communication passageway 51 is in fluid communication with cavity 29 and thus discharge 24 of pump assembly 21, while a lower exit end of communication passageway 51 is in fluid communication with conduit port 31, via transmission groove 33.

As shown in FIG. 2, transmission groove 33 extends radially about member 25 so that communication between port 31 and the bushing conduit exit end can be provided regardless of the radial position of communication passageway 51 relative to longitudinal axis 45.

FIG. 2 illustrates that removable annular member 25 is urged into bore 27 until an upper frusto-conical shoulder 57 of member 25 seats against a mating shoulder 60 of a support seating ring 61 situated atop housing extension 40.

Removable member 25 further includes seals 62 which form a sealed chamber around an upper side of pressure transmission groove 33 to prevent leakage. Lower annular member 54 similarly includes 0-ring seals 63 which seal the lower side of groove 33. Both seals 62 and 63 contact cylindrical wall 43 to provide a liquid seal therebetween, while permitting insertion and removal of members 25 and 54 from housing central bore 27. It will be appreciated that cylindrical wall 43 also could be formed with annular slots formed for seating O-ring seals.

The operation of bypass assembly 10, as shown in FIGS. 1 and 2, can now be described. It will be assumed that well casing 12 has been perforated initially at perforations 15 and production fluid has been pumped from the well for a period of time dropping the pressure in the formation at perforations 15 to an undesirably low level. The operator may elect to trigger gun 17 to reperforate casing 12 and concrete 14 at a level sufficiently below perforations 15 to access production fluids at increasing pressure. Such operator-induced triggering is usually preferred, as compared to formation-induced triggering because it is more positive and the threshold or triggering pressure can be set high enough to avoid inadvertent or premature triggering, for example, as the down-hole assembly is being inserted down the well.

Operator-induced triggering of gun 17 can be accomplished by valving off return line 28 through a valve (not shown). Due to the blockage or reduction of flow of power fluid and production fluid through duct 38 and return line 28, the fluid pressure in chamber 29 and around pump 21, caused by the up-hole pump driving the power fluid (not shown), increases. As a result, the pressure in passageways 51 and 30 are also increased which is then communicated to pressure sensor 20 through conduit 34. When the pressure reaching sensor 20 rises above the pre-set trigger pressure, sensor 20 triggers perforation gun 17.

In formation-induced triggering assemblies, sensor 20 includes a first transducer which monitors the pressure in chamber 29, through the bypass passageways and conduit, as the pump operates. As pumping proceeds, a second pressure transducer monitors the pressure of production fluid in well casing 12 at the perforation gun depth. When the differential increases to over a predetermined amount, as a result of dropping formation pressure, sensor assembly 20 triggers gun 17.

Thus, bypass assembly 10 will accommodate either operator-induced or formation-induced triggering.

When perforation gun 17 is triggered, the detonation and in-rushing production fluid predictably destroy or sever a portion of conduit 34. If bypass conduit assembly 10 is not closed or shut off, continued pumping of pump 21 will not only pump power and production fluids up return line 28, but will pump such fluids down conduit assembly 10 and back into formation 13 through the severed bypass conduit 34. This, of course, ,greatly reduces pumping efficiency.

In order to prevent reinjection of production and power fluids into the formation, bypass conduit assembly 10 is formed in a manner allowing blocking of the bypass conduit after operation of the perforation gun. Most preferably, this is accomplished by providing one of the bypass conduit forming members as a movable, and most preferably removable, member.

In the embodiment shown in FIGS. 1 and 2, annular member 25 with communication passageway 51 is formed for removal and replacement by an insert which blocks the bypass conduit assembly. In the embodiment shown in FIG. 3, blockage of bypass conduit assembly 10 is accomplished by using an insert member 35 which repositions standing valve assembly 50 at a position between chamber 29 and port 31 to passageway 30.

Accordingly, after operator-induced or formation-induced triggering, pump 21 is removed from the bottom-hole assembly, for example by pumping power fluid down return conduit 28. Removable member 25 and the attached annular member 54 and standing valve 50 are removed from within down-hole housing 26, for example, by fishing out these components in a manner well known in the industry.

Figure 3:
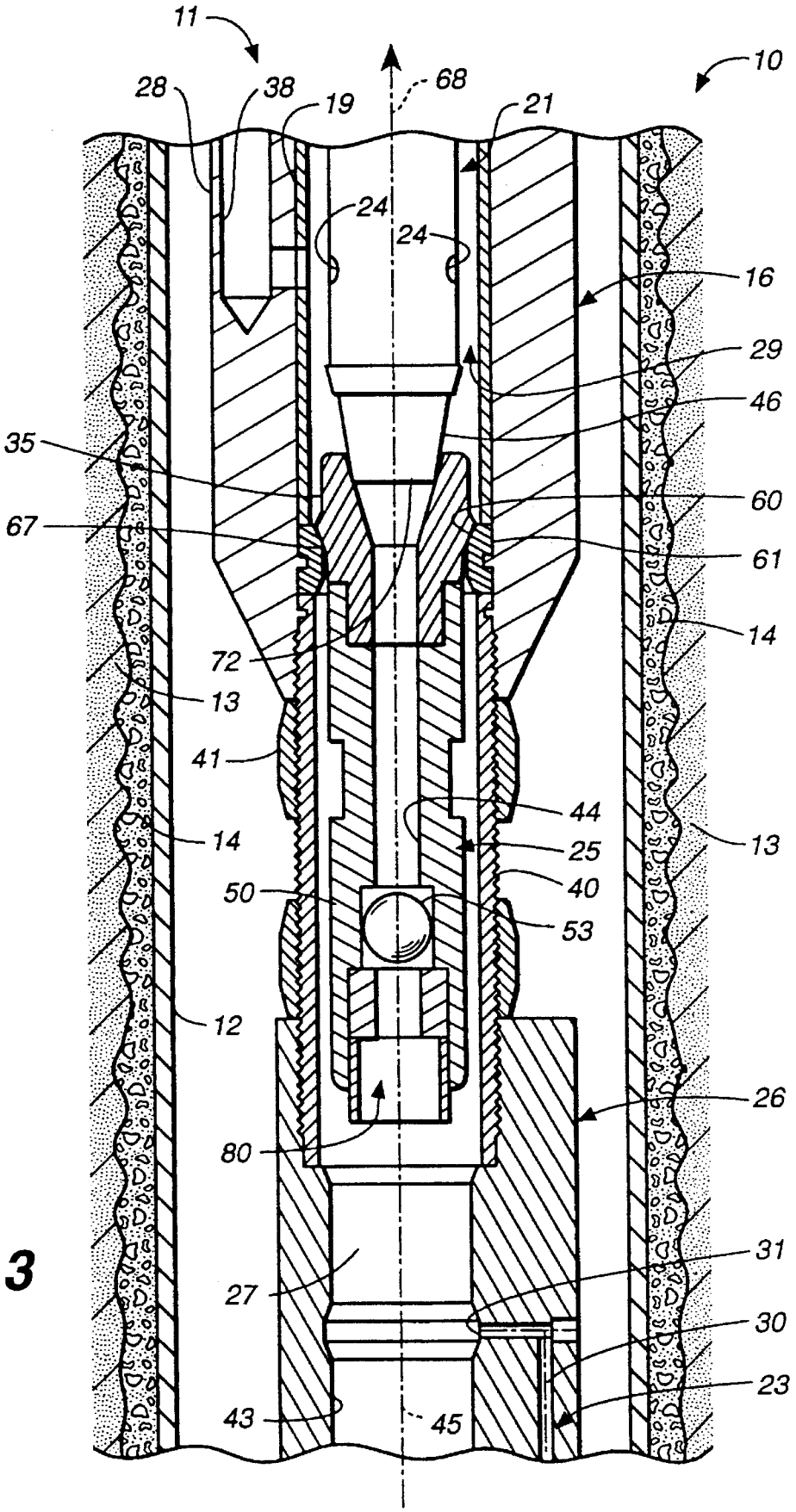
FIG. 3 is a fragmentary side elevation view, in cross-section, of the perforation trigger bypass apparatus of FIG. 2 and illustrating the bypass conduit assembly in a closed condition.

As will be seen in FIG. 3, the shorter insert member 35 repositions standing valve assembly 50 between chamber 29 and groove 33 and port 31. This prevents pump 21 from pumping power and production fluid down past valve assembly 50 and to housing conduit 30. Accordingly, the fluid communication link between pump discharge end 24 and severed tube 34 is removed or the bypass conduit assembly can be considered to be in a "closed" condition.

Insert member 35 includes a frusto-conical shoulder 67 which is formed to support and seat insert 35 and standing valve 50 against shoulder portion 60 of support seating ring 61. This seating is sufficient to prevent fluid flow therebetween so that pump discharge end 24 is out of fluid communication with housing port 31. Accordingly, the removal and insertion procedures can be conducted while a substantial portion of the bypass conduit assembly, and particularly housing 26 and conduit 34, remains resident in the well.

In an alternative embodiment, communication passageway 51 in annular member 25 can merely be blocked. Thus, the removable member 25 can be brought to the well surface and a plug (not shown) inserted into communication passageway 51. The member 25 with coupled standing valve can then be returned to the bottom-hole assembly 16.

From the description of the present apparatus, it will be understood that the method for preventing discharge of pumped fluid from a perforation trigger bypass apparatus back into the formation, comprises the steps of: after discharge of the perforation gun assembly, blocking pressure bypass conduit 23 to prevent communication of pumped fluids back into the well casing and formation through the severed bypass conduit by moving a movable portion of bypass conduit assembly 23 from an open condition to a closed condition, preferably while a substantial portion of the conduit assembly remains in residence in the well.

Most preferably, in the present method, the blocking step is accomplished by: selectively withdrawing a bushing member 25 which contains a portion 51 of conduit assembly 23 from slidable receipt in a central bore 27 of down-hole housing assembly 26, and inserting a new insert member 35 into bore 27 to block bypass conduit 23.

The new insert repositions standing valve assembly 50 between pump 21 or chamber 29 and port 31 to the severed bypass conduit 34.

What is claimed is:

1. A perforation trigger bypass apparatus for a down-hole completion assembly including a rigid, elongated tubular casing extending into a formation producing a production fluid, a tubular completion assembly positioned in said casing, a fluid line in fluid communication with said tubular completion assembly, a perforation gun assembly positioned in said casing at a down-hole location below said tubular completion assembly and capable of a controlled detonation to form a set of perforations in said casing for retrieval of said production fluid therethrough, and a pressure sensing device formed to sense a detonation pressure in fluid communication with said fluid line through said tubular completion assembly, said sensing device operably coupled to said gun assembly to trigger said detonation upon said detonation pressure surpassing a predetermined value, said bypass apparatus comprising:

a bypass conduit assembly defining a communication conduit connected to and providing fluid communication between said tubular completion assembly and said pressure sensing device for the communication of said detonation pressure to said sensing device, said bypass conduit assembly being formed for selective blocking of the passage of a pumped fluid from said tubular completion assembly through said communication conduit and into said formation in the event of severing of a portion thereof during the detonation of said gun assembly.

2. The bypass apparatus as defined in claim 1 wherein, said bypass conduit assembly includes a removable member having a communication passageway portion of said communication conduit therein, said removable member being formed for removal while a substantial portion of said bypass conduit assembly remains resident in said down-hole completion assembly.

3. The bypass apparatus as defined in claim 2, and an insert member formed for positioning in said bypass conduit assembly in place of said removable member upon removal thereof, said insert member blocking communication of said pressurized fluid to a severed portion of said bypass conduit assembly.

4. The bypass apparatus as defined in claim 3 wherein, said down-hole completion includes a pump assembly operably supported on said tubular completion assembly and formed to extract said production fluid from said formation through said casing, and said insert member has a standing valve assembly mounted to a lower end thereof, and said insert member positions said standing valve assembly between said pump assembly and said severed portion of said bypass conduit assembly.

5. The bypass apparatus as defined in claim 1 wherein, said down-hole completion includes a pump assembly operably supported on said tubular completion assembly and formed to extract said production fluid from said formation through said casing, and said bypass conduit assembly further formed and connected to provide fluid communication between a discharge end of said pump assembly and said pressure sensing device for the communication of said detonation pressure to said sensing device.

6. The bypass apparatus as defined in claim 5 wherein, said bypass conduit assembly includes a movable member having a communication passageway portion of said communication conduit therethrough in fluid communication with said pump discharge end, a housing positioned in said casing and mounted to said tubular completion assembly, said housing providing a housing passageway portion of said communication conduit having one end in fluid communication with said communication passageway in said movable member, and a bypass conduit defining a bypass passageway portion of said communication conduit communicably coupled between an opposite end of said housing passageway and said sensing device for communication of said detonation pressure from said pump discharge end to said sensing device.

7. The bypass apparatus as defined in claim 6 wherein, said housing defines a central bore extending therethrough for fluid communication between said casing and said pump assembly.

8. The bypass apparatus as defined in claim 7 wherein, said housing passageway portion includes a port at a mid-portion of said central bore to provide fluid communication with the movable member communication passageway portion, and said movable member of said bypass conduit assembly is provided by a member dimensioned for sliding movement in said housing central bore to permit removal therefrom.

9. The bypass apparatus as defined in claim 8 wherein, said movable member and said housing defining said central bore being formed to define a pressure transmission groove cooperating with said port to communicably couple said pump discharge end to said passageway in said housing.

10. The bypass apparatus as defined in claim 9 wherein, said transmission groove is an annular ring peripherally extending around said movable member proximate to and in fluid communication with said port.

11. The bypass apparatus as defined in claim 10 wherein, one of said housing and said movable member includes a seal member positioned in said central bore in fluid sealing engagement between said movable member and said housing at a location above said port, and said housing further has a seal member positioned in said central bore below said port.

12. A perforation trigger bypass conduit assembly for use with a down-hole completion assembly including a casing, a tubular completion assembly positioned in said casing, a pump operably supported on said tubular completion assembly, a perforation gun assembly positioned in said casing at a down-hole location remote from said tubular completion assembly, a pressure sensing device mounted proximate and coupled to trigger said perforation gun assembly, and a fluid pressure transmitting bypass conduit coupling said pump to said sensing device, said bypass conduit assembly comprising:

a housing assembly mounted to said tubular completion assembly and defining a bore extending therethrough for fluid communication between said casing and said pump assembly, said housing being formed with a housing passageway therethrough;

a severable conduit coupled to one end of said housing passageway and coupled at an opposite end to said sensor;

a removable member dimensioned for sliding receipt in said housing bore and formed with a member passageway therethrough communicably coupled to said housing passageway whereby said member passageway, housing passageway and severable conduit transmit pressure from a discharge end of said pump to said sensor.

13. The trigger bypass conduit assembly as defined in claim 12 further including: and an insert member formed and dimensioned for sliding receipt in said bore, after removal of said removable member from said bore, said insert member being formed to block passage of pumped fluid discharged from said discharge end of said pump through a severed portion of said severable conduit while a substantial portion of said bypass conduit assembly remains in residence in said down-hole completion assembly.

14. The bypass apparatus as defined in claim 13 wherein, said insert member has a standing valve mounted to a lower end thereof.

15. A perforation trigger bypass apparatus for a well assembly including a rigid, elongated tubular casing extending into a formation producing a production fluid, a bottom-hole assembly positioned in said casing, a pump assembly operably supported thereon and formed to extract said production fluid from said well assembly through said casing, a perforation gun assembly positioned in said casing at a down-hole location below said bottom-hole assembly and capable of a controlled detonation to form a set of perforations in said casing for retrieval of said production fluid therethrough, and a pressure sensing device formed to sense a detonation pressure in fluid communication with said pump assembly, said sensing device operably coupled to said gun assembly to trigger said detonation upon said detonation pressure surpassing a predetermined value, said bypass apparatus comprising:

a bypass conduit assembly defining a communication conduit connected to and providing fluid communication between a discharge end of said pump assembly and said pressure sensing device for the communication of said detonation pressure to said sensing device, said bypass conduit assembly being formed for selective blocking of the passage of a pumped fluid from said discharge end through said communication conduit and into said formation in the event of severing of a portion thereof during the detonation of said gun assembly.

16. The bypass apparatus as defined in claim 15 wherein, said bypass conduit assembly includes a removable member having a communication passageway portion of said communication conduit therein, said removable member being formed for removal while a substantial portion of said bypass conduit assembly remains resident in said well assembly.

17. The bypass apparatus as defined in claim 16 further including, and an insert member formed for positioning in said bypass conduit assembly in place of said removable member upon removal thereof, said insert member blocking communication of pumped fluid to a severed portion of said bypass conduit assembly.

18. The bypass apparatus as defined in claim 17 wherein, said insert member has a standing valve assembly mounted to a lower end thereof, and said insert member positions said standing valve assembly between said pump assembly and said severed portion of said bypass conduit assembly.

19. A method of preventing discharge of a pumped fluid, from a fluid line coupled to a tubular completion, back into a formation upon perforation of a down-hole completion assembly comprising the step of:

after perforation of said down-hole completion assembly using a perforation gun positioned down-hole from said tubular completion, blocking a bypass conduit assembly, providing fluid communication between said tubular completion and said perforation gun for triggering thereof, to prevent communication of pumped fluid from said fluid line into said formation in the event of severing of a portion of said bypass conduit assembly during detonation of said perforation gun.

20. The method as defined in claim 19 wherein, said blocking step is accomplished by removing a portion of said bypass conduit assembly from said down-hole completion assembly while a substantial fixed portion of said bypass conduit assembly remains in residence in said down-hole completion assembly.

21. The method according to claim 19 wherein, said bypass conduit assembly includes a removable member mounted in a down-hole housing and having a passageway therethrough forming part of said bypass conduit assembly, and an insert member without a bypass conduit passageway; and said blocking step is accomplished by:

withdrawing said removable member from said housing, and thereafter inserting said insert member into said housing to block said bypass conduit assembly.

* * * * *